US009714523B2

(12) United States Patent
Lilly, II et al.

(10) Patent No.: US 9,714,523 B2
(45) Date of Patent: Jul. 25, 2017

(54) SELECTIVELY CONNECTABLE SOFTSIDE SHELTER

(71) Applicants: Curtis G. Lilly, II, Fishersville, VA (US); Steven Hicks, Waynesboro, VA (US); Angela Smiley, Goshen, VA (US)

(72) Inventors: Curtis G. Lilly, II, Fishersville, VA (US); Steven Hicks, Waynesboro, VA (US); Angela Smiley, Goshen, VA (US)

(73) Assignee: HDT Expeditionary Systems, Inc., Solon, OH (US)

( * ) Notice: Subject to any disclaimer, the term of this patent is extended or adjusted under 35 U.S.C. 154(b) by 0 days.

(21) Appl. No.: 15/248,749

(22) Filed: Aug. 26, 2016

(65) Prior Publication Data

US 2017/0058556 A1 Mar. 2, 2017

Related U.S. Application Data

(60) Provisional application No. 62/211,068, filed on Aug. 28, 2015.

(51) Int. Cl.

| | |
|---|---|
| ***E04H 15/64*** | (2006.01) |
| ***E04H 15/54*** | (2006.01) |
| ***E04H 15/18*** | (2006.01) |

(52) U.S. Cl.

CPC ..... *E04H 15/64* (2013.01); *E04H 15/18* (2013.01); *E04H 15/54* (2013.01)

(58) Field of Classification Search

CPC ..... E04H 15/18; E04H 15/54; E04H 15/64; A44B 18/00; A44B 18/0084;

(Continued)

(56) References Cited

U.S. PATENT DOCUMENTS

| | | | |
|---|---|---|---|
| 3,421,188 A | 1/1969 | Rock | |
| 3,503,101 A | 3/1970 | Kolozsvary | |

(Continued)

FOREIGN PATENT DOCUMENTS

| | | | |
|---|---|---|---|
| DE | 9307832 U1 * | 7/1993 | ..... E04H 15/425 |
| DE | 29517290 U1 * | 12/1995 | ..... E04H 15/18 |

(Continued)

*Primary Examiner* — David R Dunn
*Assistant Examiner* — Danielle Jackson
(74) *Attorney, Agent, or Firm* — Fay Sharpe LLP

(57) ABSTRACT

A connector for interlocking structures includes a first Y-shaped connector affixed to a portion of a first structure, a second Y-shaped connector affixed to a portion of a second structure. A loop-type engaging element is mounted on one of: (i) the inner faces of both the first and second arms of each of the first and second Y-shaped connectors; (ii) the outer faces of both the first and second arms of each of the first and second Y-shaped connectors. A hook-type engaging element mounted on the other of: (i) the inner faces of both the first and second arms of each of the first and second Y-shaped connectors; (ii) the outer faces of both the first and second arms of each of the first and second Y-shaped connectors. Each of the first and second Y-shaped connectors is selectively configurable to either a male configuration or a female configuration.

20 Claims, 6 Drawing Sheets

(58) Field of Classification Search
CPC ... A44B 18/0068; A44B 18/0007; B42F 1/00; A44D 2205/00
See application file for complete search history.

(56) References Cited

U.S. PATENT DOCUMENTS 4,369,356 A 1/1983 Tsurutani et al.
4,649,947 A 3/1987 Tury et al.
4,838,294 A * 6/1989 Hunt ..... E04H 6/44 135/124
4,862,563 A 9/1989 Flynn
5,008,987 A 4/1991 Armour, II
5,076,288 A 12/1991 Millard et al.
5,222,513 A * 6/1993 Hilliard ..... E04H 15/18 135/117
5,289,619 A 3/1994 Pileggi
5,394,897 A * 3/1995 Ritchey ..... E04H 15/18 135/117
5,535,928 A * 7/1996 Herring ..... A45F 5/021 224/250
5,819,474 A 10/1998 Strom
5,894,642 A 4/1999 Eberhardt
5,970,541 A 10/1999 Chiang
6,041,454 A 3/2000 Summerford
6,049,953 A 4/2000 McCay et al.
6,568,981 B1 * 5/2003 Chang ..... A63H 33/048 24/306
7,273,061 B2 * 9/2007 Choi ..... E04H 15/64 135/119
7,350,244 B1 4/2008 Handley
9,103,137 B2 * 8/2015 Williams ..... E04H 15/18
9,303,426 B2 * 4/2016 Workman ..... E04H 15/44
9,470,010 B2 * 10/2016 Youn ..... E04H 15/64
2007/0039639 A1 * 2/2007 Duncan ..... E04H 9/10 135/97

FOREIGN PATENT DOCUMENTS

DE 29716289 U1 * 10/1997 ..... E04H 15/08
JP 10037535 A * 2/1998 ..... E04H 15/18

* cited by examiner

SELECTIVELY CONNECTABLE SOFTSIDE SHELTER

CROSS-REFERENCE TO RELATED APPLICATION

This application claims the benefit of Provisional Application Ser. No. 62/211,068 which was filed on Aug. 28, 2015, and the entire content of said provisional application is incorporated hereinto by reference.

FIELD

The present disclosure relates generally to portable shelters. More particularly, it relates to a fastening system or connector construction for securing such shelters to each other, in particular, connecting the fabric coverings of such shelters together.

BACKGROUND

In the past, a wide variety of portable shelters have been used. These include tents and similar structures, as well as inflatable structures, geodesic domes and various types of prefabricated shelters. Tents have the advantages of being inexpensive, quickly erectable, portable, and generally lightweight. They are generally easily assembled, disassembled and stored when disassembled. In short, tents and portable structures of varying designs have many uses. The present disclosure is suitable for a wide variety of recreational, military and business uses whenever a sturdy, yet quickly erectable portable shelter is needed.

It is often advantageous to join or connect two or more shelters to each other or to separate them from one another as may be necessary to accomplish a particular task. A common way to join fabric shelters or tarps is to use becket lace (a short loop of rope with a knot at one end) and grommets. A traditional becket lace fastening system or connector construction has lace located on one side edge of the fabric material covering a shelter and grommets located on the other side edge of the material. However, some designs only have lace on both side edges of a strip of shelter or tarp material and beckets only on the side edges of another strip of material of the shelter or tarp meant to be connected to the first strip. If two shelters only have lace or only have beckets, the connection cannot be made. Another difficulty with becket lace-type arrangements is that at the end of the becket lace, the last two loops are knotted so that the lace cannot be pulled apart. However, often times, someone assembling such a shelter will let go of one of the loops and the whole section unlaces due to the weight of the fabric pulling on the lace. Becket lace connector constructions are also personnel intensive and require a significant amount of time to accomplish.

Other methods of connecting segments of a shelter fabric material include zippers and standard hook and loop (VELCRO®) fasteners or fastening elements. However, zippers can be difficult to start. Also, it is difficult to fasten a zipper connection on adjacent panels of the fabric so that the panels stay aligned. Zippers also break easily. A difficulty with conventional hook and loop fasteners is that a single connection joint can be pulled apart easily. Moreover, hook and loop fasteners require that the correct mating sections be installed on each panel side edge, i.e., a strip of hook material or a strip of loop material. But, since hook material does not connect to hook material, and loop material does not connect to loop material, one side edge of the shelter fabric needs to have a strip of hook material and the other side edge needs to have a strip of loop material. If one side edge of a shelter has hooks on its side edge, then the mating shelter would need to have loops on the edge which is meant to be secured thereto, and vice versa.

However, this requires the two shelters to be built differently and arranged in a particular order, both of which requirements are highly undesirable. To make them the same, one would need to manufacture all the shelter segments so that one side edge would have hook connectors and the other side edge would have loop connectors. But, if this is done, the user has to take care to set up the shelters for ready connection. If loops are facing loops or hooks are facing hooks, the shelter would need to be rotated 180° to align it with an end edge of an adjacent tent. Because shelters can be difficult to set up, rotating them to adjust their alignment with each other is problematic. For example, some of these tents, such as tents used by the military as well as by emergency response teams, weigh over 700 pounds each. Rotating a 700 pound tent is difficult, time consuming and requires multiple personnel. Moving such tents can also lead to damage when done by the untrained.

It would therefore be desirable to provide a shelter interengagement system or connector assembly which is universal so that any shelter can be secured to any other shelter, whether the open sidewalls of two shelters are connected to each other or via interconnected doorways of the two shelters. It would also be desirable to provide a connector assembly that is easy to use, is sturdy and requires a minimum number of personnel to use. Further, it would be desirable to provide a connector assembly that can be employed to connect any desired number of shelters to each other.

BRIEF SUMMARY

In accordance with one aspect of the present disclosure, a connector assembly for interlocking adjacent members includes a first Y-shaped connector affixed to a portion of a first member, a second Y-shaped connector affixed to a portion of a second member, wherein each of the first and second Y-shaped connectors includes a first arm with an outer face and an inner face and a second arm with an outer face and an inner face. A loop-type engaging element is mounted on one of: (i) the inner faces of both the first and second arms of each of the first and second Y-shaped connectors; (ii) the outer faces of both the first and second arms of each of the first and second Y-shaped connectors. A hook-type engaging element mounted on the other of: (i) the inner faces of both the first and second arms of each of the first and second Y-shaped connectors; (ii) the outer faces of both the first and second arms of each of the first and second Y-shaped connectors. Each of the first and second Y-shaped connectors is selectively configurable to either a male configuration or a female configuration and an interlocking connection between the first member and the second member is made when one of the first and second Y-shaped connectors is arranged in the male configuration and the other of the first and second Y-shaped connectors is arranged in the female configuration, and the engaging elements on the inner faces of the first and second arms of the Y-shaped connector in the female configuration are respectively lockably engaged with the engaging elements on the outer faces of the first and second arms of the Y-shaped connector in the male configuration.

According to another aspect of the present disclosure, a shelter covering with connectible ends includes a fabric material including a first end and an opposite second end. A first Y-shaped connector is mounted on the fabric first end and a second Y-shaped connector mounted on a fabric second end. The first and second Y-shaped connectors are identical and each of the first and second Y-shaped connectors comprises a first arm having outer and inner faces and a second arm having outer and inner faces. A loop material is mounted on one of: (i) the inner faces of both the first and second arms of each of the first and second Y-shaped connectors; (ii) the outer faces of both the first and second arms of each of the first and second Y-shaped connectors. A hook material mounted on the other of: (i) the inner faces of both the first and second arms of each of the first and second Y-shaped connectors; (ii) the outer faces of both the first and second arms of each of the first and second Y-shaped connectors. Each of the first and second Y-shaped connectors is selectively configurable so that the first and second arms thereof are spaced apart to form a female connector or brought adjacent each other to form a male connector.

According to still another aspect of the present disclosure, a method of interlocking adjacent members includes providing a first Y-shaped connector affixed adjacent a first end of a first member and a second Y-shaped connector affixed adjacent a second end of a second member. Each of the first and second Y-shaped connectors includes a first arm with an outer face and an inner face, and a second arm with an outer face and an inner face. Each of the outer faces includes one of a loop-type engaging element and a hook-type engaging element, and each of the inner faces including the other of a loop-type engaging element and a hook-type engaging element. A male configuration is formed from the first and second arms of the first Y-shaped connector by locating the first and second arms of the first Y-shaped connector adjacent each other, and a female configuration is formed from the first and second arms of the second Y-shaped connector by locating the first and second arms of the second Y-shaped connector to be spaced-apart from each other. The first end of the first member is placed adjacent to the second end of the second member so that the first and second ends are aligned with each other. The male configuration of the first Y-shaped connector is inserted between the spaced-apart first and second arms of the female configuration of the second Y-shaped connector such that the engaging elements located on the outer faces of the first and second arms of the first Y-shaped connector are located adjacent the engaging elements located on the inner faces of the first and second arms of the second Y-shaped connector. The engaging elements located on the outer faces of the first and second arms of the first Y-shaped connector are lockably engaged with the engaging elements located on the inner faces of the first and second arms of the second Y-shaped connector, thereby interlocking the first and second ends of the first and second members.

Among the advantages of the use of Y-shaped connectors mounted on opposite ends of a shelter covering are the durability of the connection so formed and the convenience of operation. The interengaging connectors according to the present disclosure provide a releasable connection between sheet members which connection increases in strength as the tension upon the joint members increases. Put another way, it is difficult to separate two adjacent shelter covers which have been connected via the interengaging Y-shaped connectors, as they provide two separate but adjacent parallel connections or joints, wherein each joint comprises a hook and loop fastening element. The Y-shaped connectors can be sewn or welded around the outside perimeter of a doorway when two shelters are joined at doorways. Alternatively, two open ended shelters can be joined together via Y-shaped connectors installed around the facing edges of two shelters thus providing an open ended connection. Thus, the Y-shaped connectors can be used to join shelters together in an open end style or at doorways.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

Figure 13:
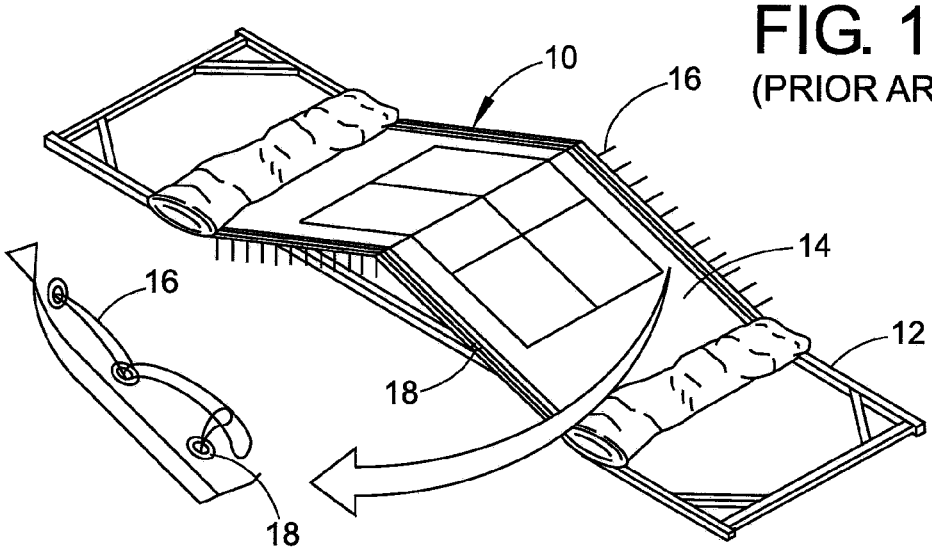
FIG. 13 (PRIOR ART)
FIG. 13 is a perspective view of a shelter segment employing a connector construction according to the prior art.

Referring now to the drawings wherein the showings are for purposes of illustrating several embodiments only and are not intended to limit same, FIG. 13 shows a shelter covering with a connector construction according to the prior art. More particularly, a shelter segment 10 comprises a frame 12 on which is supported/to which is mounted a cover 14 made of a known fabric material. The cover has located on opposed side edges thereof a set of becket lace fasteners 16 and a set of grommets 18. In this embodiment, lace fasteners are disposed on one half of each side edge of the cover fabric 14 with grommets being disposed on the other half of each side edge. As mentioned, one difficulty with becket and lace-type arrangements is that if someone assembling a shelter lets go of one of the loops of the becket lace fastener 16, that may cause the whole section to unlace due to the weight of the fabric cover 14 pulling on the lace. Moreover, it can be appreciated that pulling the becket lace 16 through the grommets 18 is a time consuming process which requires a good amount of manpower to accomplish.

Figure 1:
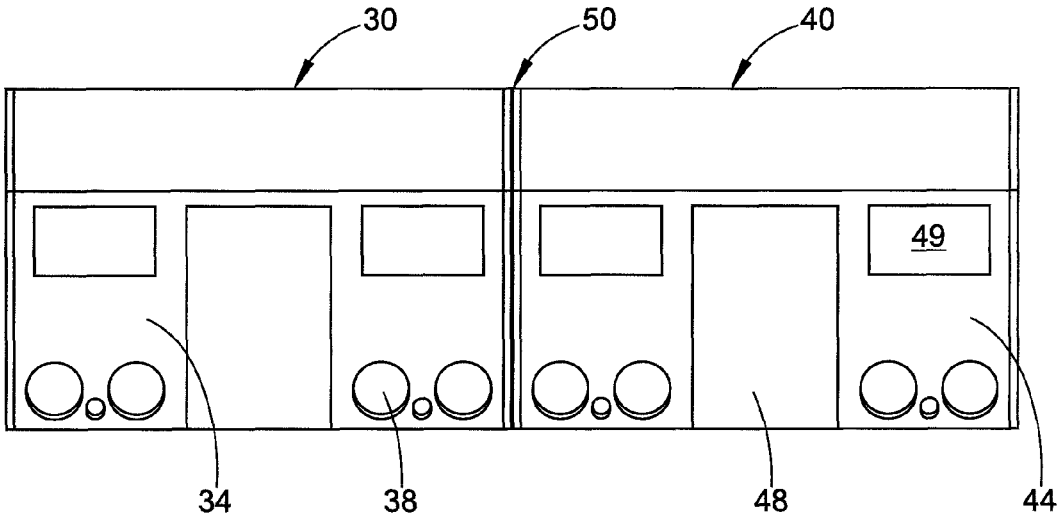
FIG. 1 is schematic side elevational view of a first embodiment of two shelters being joined together by a connector construction according to one embodiment of the present disclosure.
Figure 4:
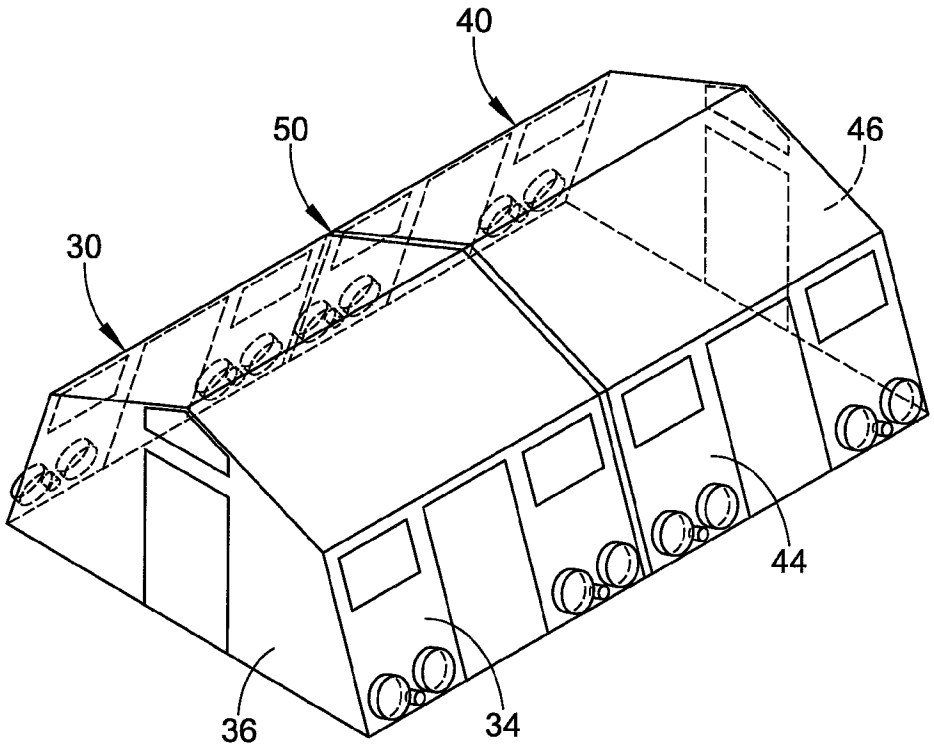
FIG. 4 is a perspective view of the two shelters of FIG. 1.
Figure 3:
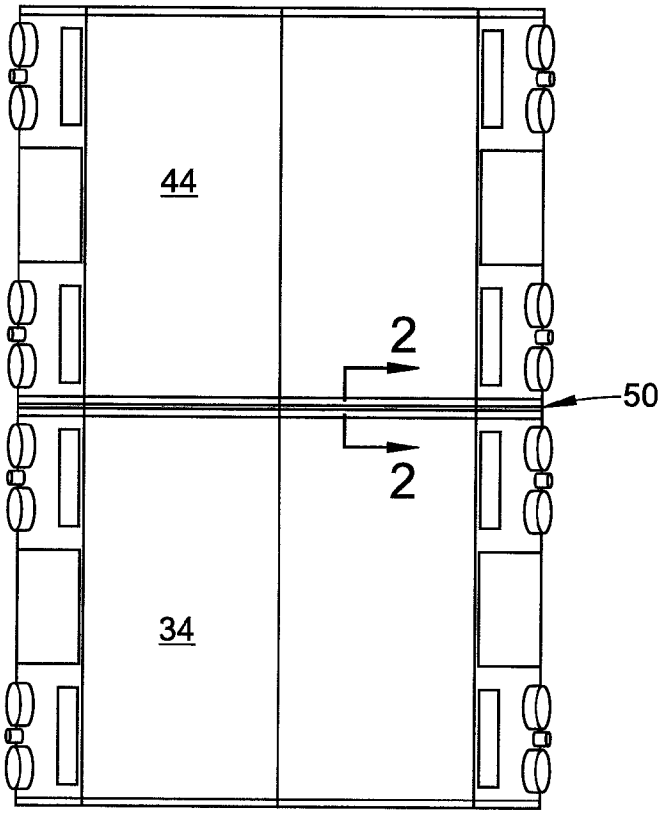
FIG. 3 is a top plan view of the two shelters illustrated in FIG. 1.
Figure 7:
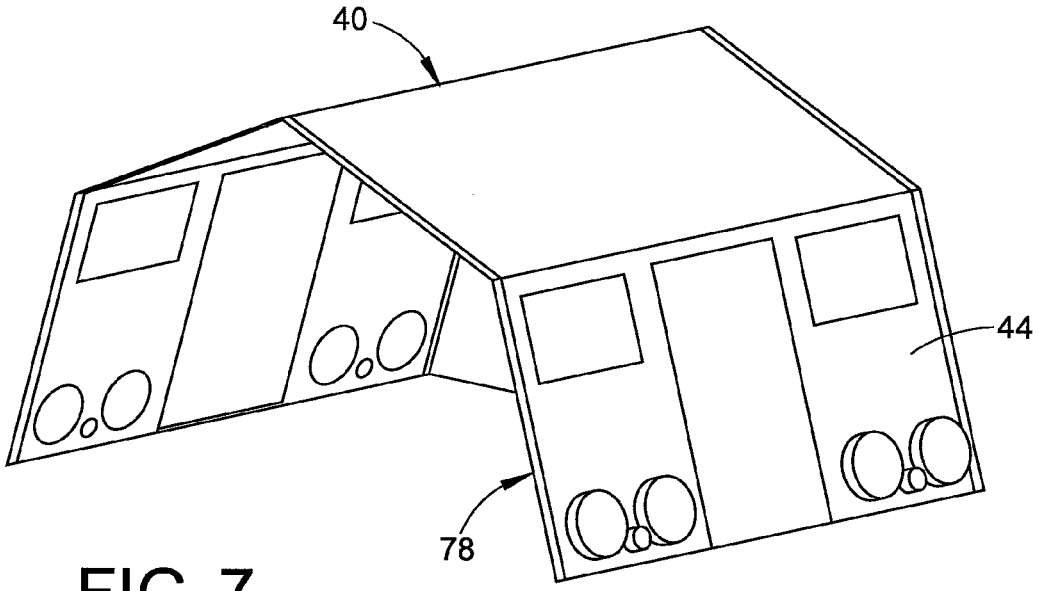
FIG. 7 is a perspective view on an enlarged scale of one of the shelters illustrated in FIG. 1.

With reference now to FIG. 1, a connection construction according to the present disclosure can be employed to connect at least two members which can be structures such as shelters 30,40 to each other to provide a combined shelter. It should be appreciated, however, that other uses of the connection construction are also feasible to connect two fabric members to each other. With reference now also to FIG. 4, provided is a first shelter 30 having a first cover 34 as well as an end panel 36 located on one end thereof. If desired, an environmental control unit (ECU) duct opening 38 can be disposed in at least one side wall of the cover 34. Joined to the first shelter 30 is a second shelter 40. The second shelter is provided with a second cover 44 and an end panel 46 (FIG. 4) located on one end thereof. Defined in the side wall of the cover 44 can be a doorway 48, as well as a window 49. Covers 34,44 are defined from a fabric or other suitable material known for use as a tent or shelter cover. Connecting the two shelters 30,40 to each other is a connector assembly or construction 50 provided in accordance with a first embodiment of the present disclosure. It should be appreciated that in this embodiment, the connected ends of the first and second shelters 30,40 are open to each other as shown in FIG. 7 to define the combined shelter. Thus, the only two end panels 36 and 46 of this shelter construction are provided on the opposed ends of the two joined together shelters 30 and 40. Needless to say, any desired number of such shelters can be joined together.

Figure 2:
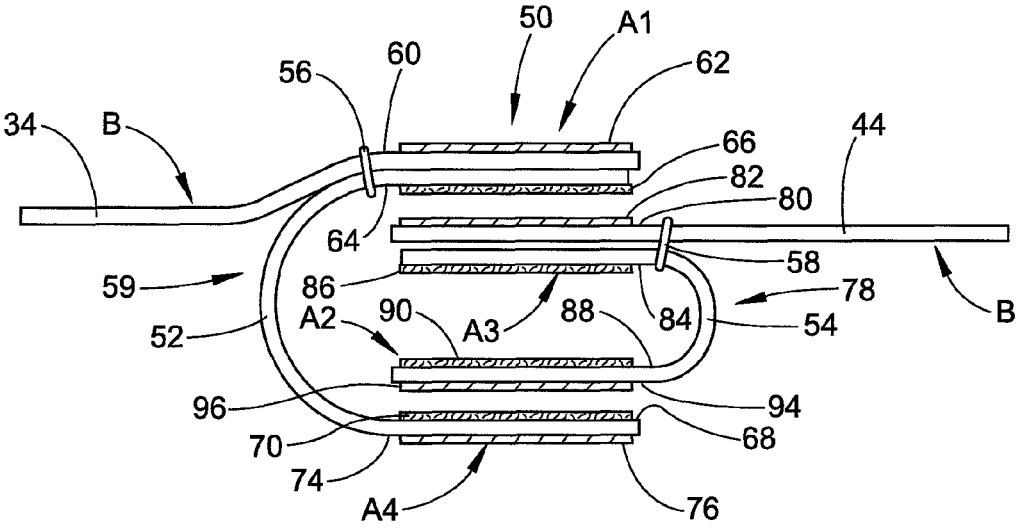
FIG. 2 is greatly enlarged cross sectional view of a portion of the two shelters of FIG. 1, located at the connector construction and taken along line 2-2 of FIG. 3 (the connectors 59 and 78 of FIG. 2 are shown with the hook-and-loop elements disengaged from each other to facilitate an understanding of the structure of the connectors)

With reference now also to FIG. 2, a connector assembly or construction 50 according to a first embodiment comprises mated first and second Y connectors 59,78 that are identically structured relative to each other but arranged or oriented in a mirror-image fashion relative to each other on opposite ends of the shelters 30,40. Each Y connector 59,78 comprises a base B which, in the illustrated embodiment, is provided by a portion of the shelter cover 34,44. Each Y connector further comprises first and second legs or arms A1,A2 (for the Y connector 59) A3,A4 (for the Y connector 78) that are connected to and that extend outwardly from the base B such that the base and arms A1,A2 and A3,A4 form a Y-shaped structure with the respective base B. In the embodiment of FIG. 2, a flap 52 (for the Y connector 59) and a flap 54 (for the Y connector 78) is respectively connected to an end portion of the shelter cover 34,44 adjacent the base B. The first arm A1,A3 comprises an end portion of the shelter cover 34,44 and an inner or first end of the respective flap 52,54, and the second arm A2,A4 comprises an outer or second end of the respective flap 52,54. As such, the first Y connector 59 comprises the first flap 52 that is mounted to the first cover 34 and the second Y connector comprises the second flap 54 which is mounted to the second cover 44. In this embodiment, each of the flaps 52,54 is fastened to its respective cover 34,44 via one or more stitches 56 and 58, which delineate the border between the base B and the first arm A1. In the illustrated embodiment, the first arm A1,A3 comprises the overlapped portions of the cover 34,44 and the respective flap 52,54, but the first arm A1,A3 can alternatively be defined only by the cover 34,44 (see e.g., FIG. 9). Alternatively, each of the flaps 52,54 is fastened to its respective cover 34,44 via adhesive or ultrasonic welding. The flaps 52,54 extend continuously and coextensively along the ends of the respective covers 34,44 such that both the first and second arms A1,A2 and A3,A4 extend continuously along the edge of the covers 34,44.

Figure 8:
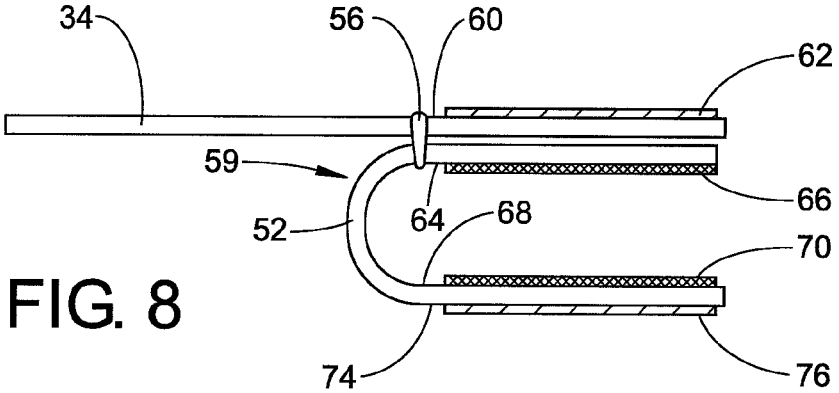
FIG. 8 is an enlarged end elevational view of one portion of the connector construction of FIG. 2.

Thus, defined is a first connector element 59 located along one side edge of the first cover 34. The first arm A1 of the connector element 59 includes an outer face 60 (which comprises the outer face of the cover 34) on which there is provided a layer or strip of loop material 62 (also referred to herein simply as a "loop element" or a "loop-type engaging element") of a hook-and-loop fastening element. One suitable hook-and-loop fastening element is available commercially under the trademark VELCRO®. The layer or strip of loop material 62 is fastened or secured to the material of the cover 34 on the outer face 60 of the first arm A1. The first arm A1 also includes an inner face 64 provided by a first end inner face of the flap 52 on which there is provided or positioned a layer or strip of hook material 66 of a hook-and-loop fastening element (also referred to herein simply as a "hook element" or a "hook-type engaging element"). The second arm A2 includes an inner surface or inner face 68 provided by an inner surface of the second end of the flap 52 on which is provided a layer or strip of hook material 70, and the second arm A2 includes an outer surface or outer face 74 provided by an outer surface of the second end of the flap 52 on which is provided a layer or strip of loop material 76. The hook material and loop material can be secured or fastened to the first and second arms A1,A2 (i.e., to the first cover 34 and the first flap 52) via stitching or other known fastener or fastening constructions such as adhesive or ultrasonic welding or the like. A view of the first connector element 59 by itself is illustrated in FIG. 8. It should be noted that the positions of the hook elements 66,70 can be respectively exchanged with the positions of the loop elements 62,76 without departing from the scope and intent of the present development, provided that the respective inner faces 64,68 of the first and second arms A1,A2 include like elements of a first type (either hook elements or loop elements) and the respective outer faces 60,74 of the first and second arms A1,A2 also include like elements of a second type (either hook elements or loop elements).

Located on the adjacent edge of the second cover 44 is a second connector element 78 that is identical to the first connector element 59 but oriented in a mirror-image fashion relative to the first connector element 59. The first arm A3 of the connector element 78 includes an outer face 80 (which comprises the outer face of the cover 44) on which there is provided a layer or strip of loop material 82 of a hook and loop fastening element. The layer or strip of loop material 82 is fastened or secured to the material of the cover 44 on the outer face 80 of the first arm A3. The first arm A3 also includes an inner face 84 provided by a first end inner face of the flap 54 on which there is provided or positioned a layer or strip of hook material 86 of a hook and loop fastening element. The second arm A4 includes an inner face 88 provided by an inner face or inner surface of the second end of the flap 54 on which is provided a layer or strip of hook material 90, and the second arm A4 includes an outer surface or outer face 94 provided by an outer surface of the second end of the flap 54 on which is provided a layer or strip of loop material 96. The hook material and loop material can be secured or fastened to the first and second arms A3,A4 (i.e., to the first cover 44 and the flap 54) via stitching or other known fastener or fastening constructions such as adhesive or ultrasonic welding or the like. Here, again, it should be noted that the positions of the hook elements 86,90 can be respectively exchanged with the positions of the loop elements 82,96 without departing from the scope and intent of the present development, provided that the respective inner faces 84,88 of the first and second arms A3,A4 include like elements of a first type (either hook elements or loop elements) and the respective outer faces 80,94 of the first and second arms A3,A4 also include like elements of a second type (either hook elements or loop elements), and provided that the first connector 59 and second connector 78 are correspondingly structured with the hook elements and loop elements thereof located in the same relative positions.

In order to seal out weather and to seal in light (such as for military blackout conditions), the first and second connector elements 59 and 78 can run continuously around the perimeter of the adjoining ends of the respective shelters 30 and 40, i.e., at least along the walls and roof. This can be seen in FIG. 7.

In one embodiment, the connector elements 59 and 78 could be made first and then attached to the shelter fabric 34,44. In another embodiment, the connector elements 59,78 could be formed by sewing the necessary components to the shelter fabric 34,44, all at the same time. One difficulty in sewing such layers to each other is that trying to sew more than two layers at a time has been found difficult. Thus, in one embodiment, the flap 52,54 and its layers of hook and loop material will be manufactured first and then the connector element would be finished while the flap is being sewn to the shelter.

As described in more detail below, each Y-shaped connector 59,78 is configurable to be in either a male configuration as shown for the connector 78 or a female configuration as shown for the connector 59. In the male configuration as shown for the connector 78, the arms A3,A4 are arranged proximate each other such that the engaging elements 82,96 on the outer surfaces 80,94 are exposed and face outwardly. In the female configuration as shown for the connector 59, the arms A1,A2 are arranged spaced-apart relative to each other such that the engaging elements 66,70 on the inner surfaces 64,68 are exposed and face inwardly toward each other. In use, the shelters 30,40 are each constructed to include the Y-shaped connectors 59 and 78 at the opposite ends of each shelter such that each connector 59,78 can extend continuously and coextensively with the cover 34,44. The shelters 30,40 are joined in an end-to-end arrangement by mating the connectors 59,78 as shown in FIG. 2 and as described above, and then engaging the exposed, outwardly facing engagement elements of the connector 78 in the male configuration with the respective adjacent inwardly facing engaging elements of the connector 59 in the female configuration to complete the assembly/connection 50.

Figure 9:
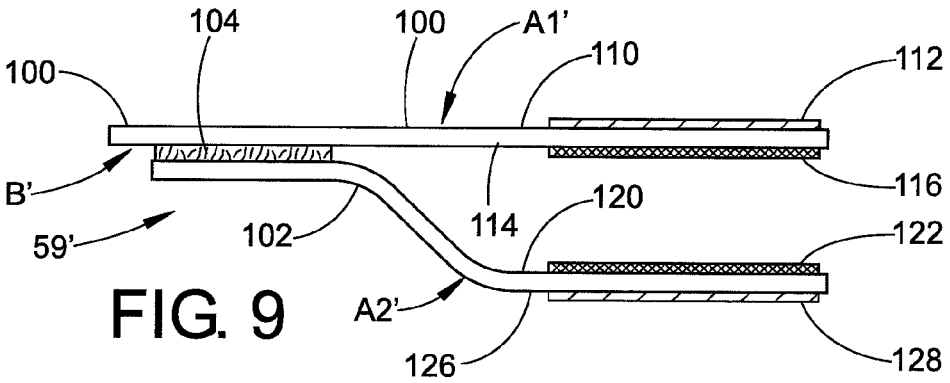
FIG. 9 is an end elevational view of a portion of a connector construction according to another embodiment of the present disclosure.

With reference now to FIG. 9, disclosed there is another Y connector construction 59' including a base B' and first and second arms A1',A2'. The Y connector 59' can be used in place of the Y connectors 59,78 described above. FIG. 9 shows the Y connector 59' arranged in a first orientation corresponding to the orientation of the Y connector 59, but the Y connector 59' can alternatively be arranged in a mirror image orientation corresponding to the Y connector 78 when installed on an opposite end of a shelter cover 100. This Y connector construction 59' comprises a fabric or other shelter cover 100 to which a flap 102 is attached, such as by a weld, an adhesive, or stitching 104. The base B' comprises a first portion of the cover 100, the first arm A1' comprises an edge of the cover 100, and the second arm A2' comprises the flap 102. The adhesive or weld 104 separates the base B' from the first and second arms A1',A2'. The flap 102 extends continuously and coextensively along the cover 100 such that both the first and second arms A1',A2' extend continuously along the edge of the cover 100. In this construction, an outer face 110 of the first arm A1' (outer face of the cover 100) includes a layer or strip of loop material 112 secured thereto. Fastened to an inner face 114 of the first arm A1' (inner face of the cover 100) is a layer or strip of hook material 116. Secured to an inner face 120 of the second arm A2' (inner face of the flap 102) is a layer or strip of hook material 122 and secured to an outer face 126 of the second arm A2' (outer face of the flap 102) is a layer or strip of loop material 128. As mentioned previously, the flap 102 can have its layers of hook and loop material 122 and 128 fastened (stitched or welded, for example) to the flap before the flap itself is fastened to the cover 100, if so desired. Also, as noted for the connectors 59,78, the positions of the hook elements 116,122 can be respectively exchanged with the positions of the loop elements 112,128 without departing from the scope and intent of the present development, provided that the respective inner faces 114,120 of the first and second arms A1',A2' include like elements of a first type (either hook elements or loop elements) and the respective outer faces 110,126 of the first and second arms A1',A2' also include like elements of a second type (either hook elements or loop elements).

Figure 5:
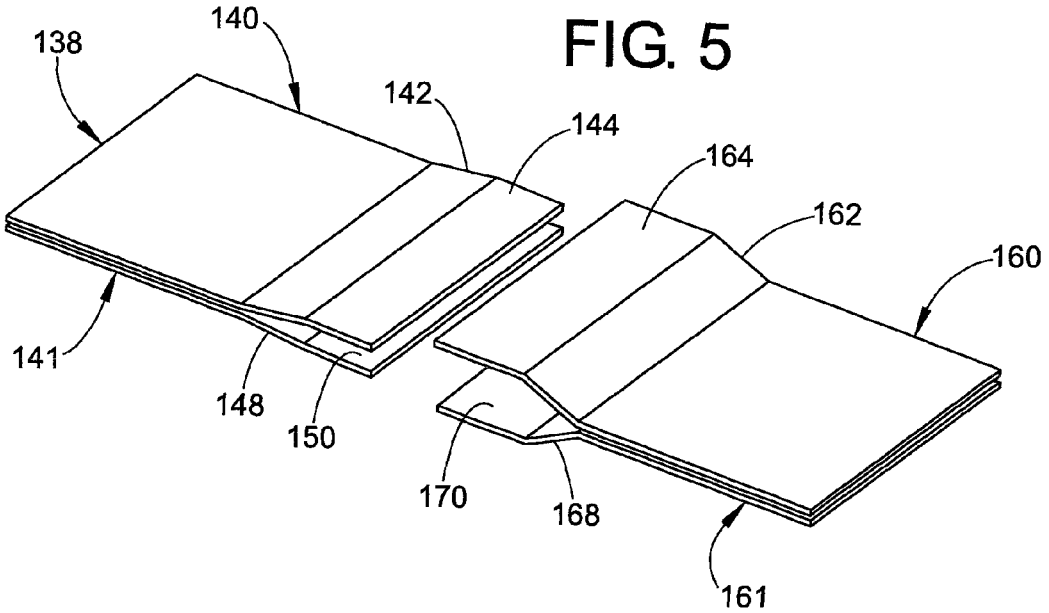
FIG. 5 is an exploded perspective view of a connector construction according to another embodiment of the present disclosure, illustrating one configuration of a joint which can be formed by the connector construction.

With reference now to FIG. 5, disclosed there is another connector assembly or construction 138 that is used in the same manner as the connector construction 50 to attached first and second shelters 30,40 to each other. In this embodiment, the connector construction includes a first Y connector 140 including a base 141, and first and second legs or arms 142,148 that are connected to and extend outwardly from the base 141 in a bifurcated manner. Secured to an outer face of the first arm 142 is a layer of hook material 144. Secured to an inner face of the second arm 148 is a layer of loop material 150. Not visible in FIG. 5 is the inner face of the first arm 142, opposite the outer face of the first arm, to which there is secured another layer of loop material. Similarly, not visible is the outer face of the second arm 148, opposite the inner face of the second arm, to which there is secured a layer of hook material. Also provided for the connector assembly 138 is a second Y connector 160 that is identically structured relative to the first Y connector 140 and oriented in a mirror image orientation relative to the first Y connector. The second Y connector includes a base 161, and first and second legs 162,168 that are connected to and extend outwardly from the base 161 in a bifurcated manner. The first arm 162 includes an outer face to which is secured a layer of hook material 164. A layer of loop material 170 is secured to an inner face of the second arm 168. Not visible in FIG. 5 are the inner face of the first arm 162, opposite the outer face of the first arm, to which there is secured a layer of loop material and the outer face of the second arm 168, opposite the inner face of the second arm, to which there is secured a layer of hook material.

The connector 138 of FIG. 5 differs from the connector embodiment 50 illustrated in FIG. 2 in that the strips or layers of loop material are located on the inside surfaces of the arms 142,148 and 162,168 and the hook material is located on the outside surfaces of the arms 142,148 and 162,168, but these relative positions of the loop material and hook material can be reversed.

One advantage of locating the hook material strips on the inside faces of the Y-shaped connector as shown in FIG. 2 is that if they were on the outside faces, the hooks would pick up grass, threads and any small stringy items when placed on the ground. So for that reason, the embodiment of FIG. 2 has the hook material layers located on the inside faces of the connector assemblies with the strips of loop material being located on the outside faces of the connector assemblies. However, if the loop material is located on the outside faces, it tends to pick up water or ice when the shelter is placed on wet ground. Moreover, when it is cold, that may make the loop material cold enough so that it does not stick well to the hook material. Thus, there are reasons why one would wish to place the hook material layers on the outside faces of the connector assembly with the layers or strips of loop material being located on the inside faces. Thus, either location for the strips or layers of the hook material and the loop material may be advantageous for the connector construction disclosed herein depending on the contemplated uses.

Figure 6:
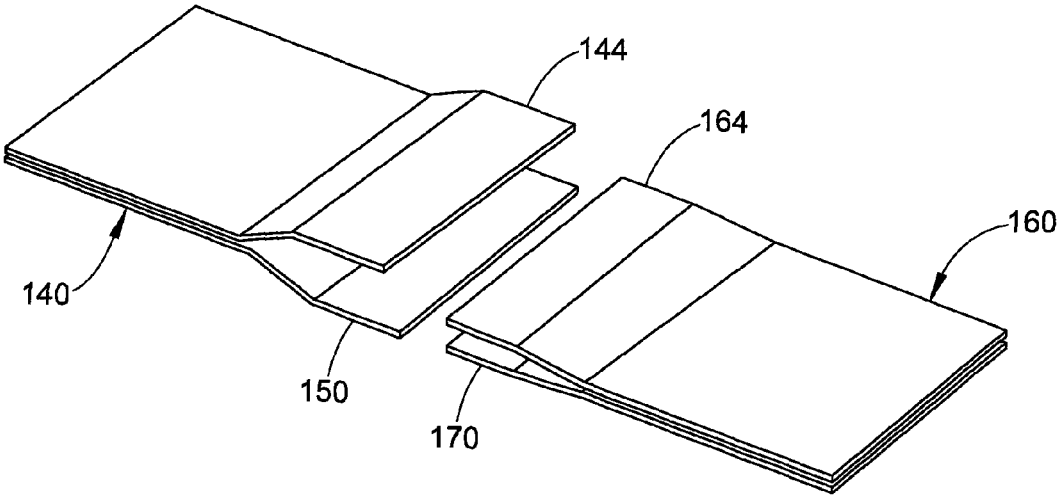
FIG. 6 is a perspective view of the connector construction of FIG. 5 with the joint shown in another configuration.

In the embodiment of FIG. 5, the first Y connector 140 is shown in the closed male configuration with its first and second arms 142,148 abutted or at least proximate each other, and the second Y connector 160 is shown in the open female configuration with its arms 162,168 spaced apart from each other to define a space between the arms for receiving the arms 142,148 of the first Y connector 140. Thus, when the first and second arms of the respective Y-shaped connector abut or lie adjacent/proximate each other, the connector forms the male configuration. In contrast, when the first and second arms of the Y-shaped connector are spaced apart from each other, the connector forms or assumes the female configuration. In FIG. 6, the first Y connector 140 is shown in the female configuration with the second Y connector 160 being shown in the male configuration. Thus, either connector can be closed slightly or opened slightly to make the connection. It does not matter which connector assembly is opened and which one is closed. Either connector assembly can be opened or closed to make the required connection between the two adjacent shelters or fabrics materials meant to be connected.

While FIGS. 5 and 6 illustrate the two Y connectors as being formed either as a male connector or as a female connector, it is conceivable that the legs of both connectors 140,160 could be opened to the female position, and the several arms thereof interleaved in an alternating arrangement to make the connection between the two shelters 30,40 in question. However, it is possible that such a connection would tend to pull to one side if joined in that way. If so, this may not be as secure a connection.

The connector constructions disclosed herein significantly reduce and, perhaps completely prevent, the ingress of sand, dust, rain, precipitation, moisture, melting snow, water runoff, water from the ground, flying or crawling insects and animals into the connected shelter construction. As mentioned, the connector construction also serves to block the emission of light at the connection between two shelters. Further, the connector construction is strong so that the two shelters will stay connected until it is desired to disconnect them from each other.

Figure 10:
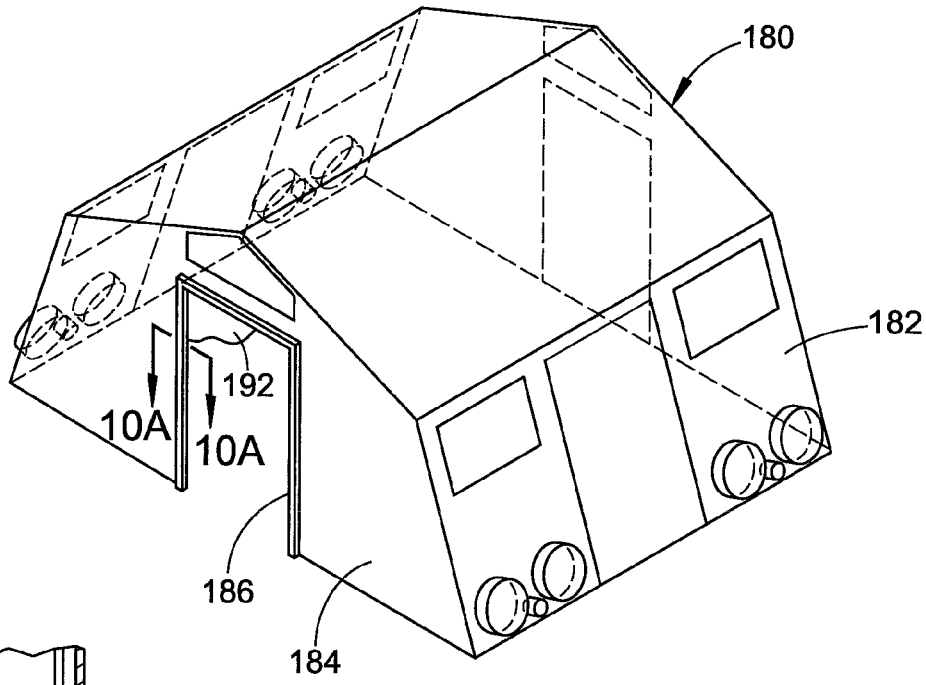
FIG. 10 is a perspective schematic view of a shelter to which is mounted a portion of a connector construction according to still another embodiment of the present disclosure.
Figure 10A:
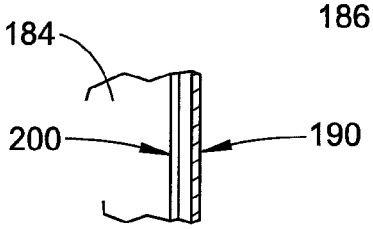
FIG. 10A is a greatly enlarged schematic view of a portion of the shelter of FIG. 10 along line 10A-10A.

With reference now to FIG. 10, disclosed there is another shelter 180 according to another embodiment of the present disclosure. In this embodiment, the shelter 180 is covered with a fabric cover 182 defined from fabric or another suitable shelter cover material. The shelter 180 comprises an end panel, wall or face 184 in the cover material in which there is defined a door opening 186. With reference now also to FIG. 10A, a zipper connector 190 is mounted to the cover material and extends around an edge of the door opening 186. In one embodiment, the zipper connector comprises two spaced sections located on the left and right sides of the opening, with the top being fabric so that the door rolls up and is tied in place. In another embodiment, the zipper connector extends across one side of the opening as well as the top and bottom of the opening. Selectively closing the door opening 186 is a closure or door 192. The door 192 has a cooperating zipper connector on it so as to engage the zipper connector 190 mounted to the cover in order to secure the door in the door opening. Also provided adjacent the door opening 186 and extending continuously and coextensively along at least three sides of the door opening 186 is a Y connector 200 according to an embodiment of the present disclosure. The Y connector 200 extends around the door opening 186 in a manner somewhat spaced from the zipper connector 190 so as to surround same. As with the zipper connector 190, the Y connector extends continuously around the door opening 186 so as to allow one shelter to be secured to another shelter via cooperating connectors. The Y connector 200 is structured according to the any of the Y connectors 59,78,59',140,160 described above.

Figure 11:
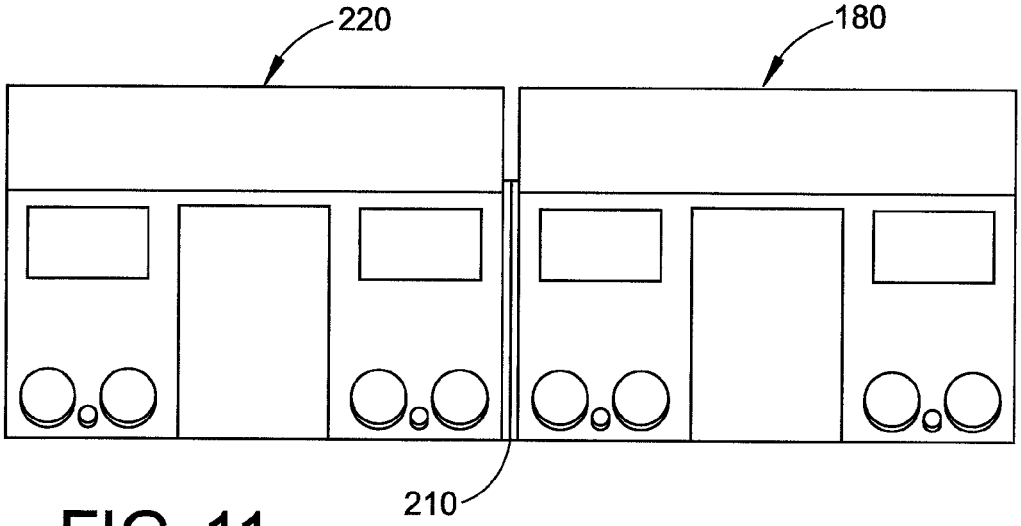
FIG. 11 is a side elevational view of two shelters which are connected together by a connector construction according to the present disclosure, a part of which was shown in FIG. 10.
Figure 12:
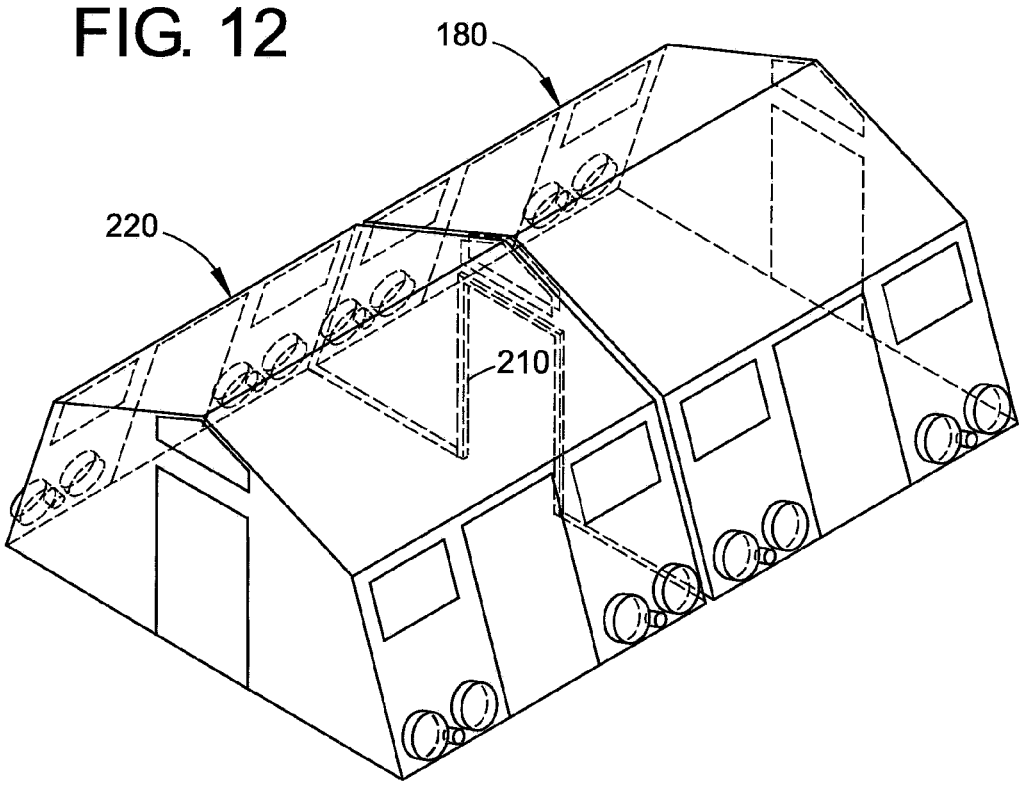
FIG. 12 is a schematic perspective view of the two shelters of FIG. 11.

With reference now to FIG. 11, the shelter 180 can be termed a first shelter which is secured via a connector construction or joint 210 to a second shelter 220. In other words, cooperating Y connectors, such as connector 200, are provided on each of the shelters 180 and 220 adjacent their respective door openings 186. The Y connector 200 can be of any of the designs previously illustrated herein and are installed around the perimeter of the respective door opening 186 of each of the shelters 180 and 220. When two shelters, such as 180 and 220 are secured together via the connector construction 210, the respective doors 192 that generally close the doorways 186 are rolled up out of the way. This allows users to walk through the connected doorways without operating the door. However, the door can be just as easily unrolled and zipped closed if so desired.

It is contemplated that a shelter construction of the type illustrated herein could be provided with both the Y-shaped connector disposed around the periphery of the door opening as shown in FIG. 10 (for a connected doorway construction) and installed around the edge of the shelter as shown in FIG. 7 for an open ended connection. In that circumstance, the end panel containing the door opening would be removed to create a full width opening between the shelters, such as is illustrated in FIG. 7.

It should be appreciated that the connector assembly disclosed herein forms a double layer or double joint of hook and loop connections between adjacent shelters or between adjacent panels of fabric material constituting the covering on a shelter. Thus, a sturdy connection can be made between adjacent shelters and in a much faster manner than with the prior art becket lace and grommet shelter connection structures. Further, it takes much less manpower to form the connection between two shelters. A connector assembly as disclosed herein is more difficult to separate than pulling apart a single hook and loop-type connection. A connector assembly as disclosed herein is useful for the purpose of joining shelters together either at doorways using a connection 210 as shown in FIG. 11) or by removing the end panels 184 to join shelters together open end style, such as is illustrated in FIG. 4 using a connection 50.

It should be appreciated that the first and second Y-shaped connectors are identically disposed on the first and second ends of the fabric material constituting the roof and sidewalls of a shelter. Alternatively, a Y-shaped connector can be affixed to an end wall of a shelter structure and disposed around the perimeter of a doorway defined in the shelter structure.

The connector assembly disclosed herein can be secured to a variety of conventional fabrics employed for shelters. In most cases, the fabric would meet military standards for strength, mildew resistance, light penetration and the like. However, none of these is a requirement for making the connector assembly work.

One advantage of the connector assembly illustrated herein is that the connector assembly is universal and ambidextrous or hermaphroditic. It allows the exact same Y connector to be installed adjacent both side edges of each of two shelters or adjacent the doors of two shelters. No matter which two openings or shelters are connected, the connector assembly from one side will connect to the connector assembly on the other side, without regard to the orientation of the shelters relative to each other. Thus, the shelters don't have to be rotated in order to be connected to each other.

Another advantage of the connector assembly according to the present disclosure is that the connector construction can be made to be either male or female as may be desirable. Because all connections are identical, a user need not worry about having the correct connector in order to secure two shelters to each other. Further, using the hook and loop arrangement disclosed herein, the two sections or two shelters are firmly connected as soon as the two connector assemblies are pressed together. This eliminates the problem with the prior art of the becket lace pulling apart if one lets go of the lace.

Further, one or more shelters can be connected to any other shelter without the use of any additional equipment and without excess handling of the connection structure. Furthermore, the connector construction disclosed does not require a connector of one type to be located on one shelter and a connector of a second type to be located on the other shelter. Thus, all shelters are readily interconnectable.

While the connector construction or system disclosed herein has been described in connection with a shelter, it should be appreciated that the connector system can be employed in a variety of other fabric assemblies. These include tarps, awnings, flexible flanges on rigid panels, as well as the types of tarps or fabric coverings used on truck trailers.

The exemplary embodiments of the present disclosure have been described with reference to several drawings. Obviously, modifications and alterations will occur to others upon a reading and understanding of the preceding detailed description. It is intended that the disclosure not be limited to the embodiments described. Rather, the present disclosure should be construed as including all modifications and alterations which come within the scope of the appended claims or the equivalents thereof.

The invention claimed is:

1. A connector assembly for interlocking adjacent members, the connector assembly comprising:

a first Y-shaped connector affixed to a portion of a first member, a second Y-shaped connector affixed to a portion of a second member, wherein each of the first and second Y-shaped connectors includes a first arm with an outer face and an inner face, a second arm with an outer face and an inner face;

a loop-type engaging element mounted on one of: (i) the inner faces of both the first and second arms of each of the first and second Y-shaped connectors; (ii) the outer faces of both the first and second arms of each of the first and second Y-shaped connectors;

a hook-type engaging element mounted on the other of: (i) the inner faces of both the first and second arms of each of the first and second Y-shaped connectors; (ii) the outer faces of both the first and second arms of each of the first and second Y-shaped connectors;

wherein each of the first and second Y-shaped connectors is selectively configurable to either a male configuration or a female configuration and an interlocking connection between the first member and the second member is made when one of the first and second Y-shaped connectors is arranged in the male configuration and the other of the first and second Y-shaped connectors is arranged in the female configuration, and the engaging elements on the inner faces of the first and second arms of the Y-shaped connector in the female configuration are respectively lockably engaged with the engaging elements on the outer faces of the first and second arms of the Y-shaped connector in the male configuration.

2. The connector assembly of claim 1, wherein the first Y-shaped connector is affixed adjacent a first end wall of the first member.

3. The connector assembly of claim 2, wherein the second Y-shaped connector is affixed adjacent a second end wall of the second member such that the second member is connectable to the first member.

4. The connector assembly of claim 2, further comprising a third Y-shaped connector affixed to a second end wall of the first member, said second end wall of the first member located on a side opposite said first end wall of said first member.

5. The connector assembly of claim 4, wherein the first and third Y-shaped connectors are identical.

6. The connector assembly of claim 5, wherein the first and third Y-shaped connectors are identically disposed on the first and second end walls of the first member.

7. The connector assembly of claim 1, wherein the first member comprises a first structure and the first Y-shaped connector is affixed adjacent a doorway of the first structure.

8. The connector assembly of claim 7, wherein the second member comprises a second structure and the second Y-shaped connector is affixed adjacent a doorway of the second structure.

9. The connector assembly of claim 1, wherein the first and second arms of each of the first and second Y-shaped connectors are proximate each other to form the male configuration.

10. The connector assembly of claim 1, wherein the first and second arms of the first and second Y-shaped connectors are spaced apart from each other to form the female configuration.

11. The connector assembly of claim 1, wherein the first and second members each comprise a shelter.

12. The connector assembly of claim 11, wherein the shelters comprise a fabric material.

13. A shelter covering with connectible ends comprising:

a fabric material including a first end and an opposite second end;

a first Y-shaped connector mounted on the fabric material first end;

a second Y-shaped connector mounted on the fabric material second end;

wherein the first and second Y-shaped connectors are identical and each of the first and second Y-shaped connectors comprises a first arm having outer and inner faces and a second arm having outer and inner faces;

a loop material mounted on one of: (i) the inner faces of both the first and second arms of each of the first and second Y-shaped connectors; (ii) the outer faces of both the first and second arms of each of the first and second Y-shaped connectors;

a hook material mounted on the other of: (i) the inner faces of both the first and second arms of each of the first and second Y-shaped connectors; (ii) the outer faces of both the first and second arms of each of the first and second Y-shaped connectors;

wherein each of the first and second Y-shaped connectors is selectively configurable so that the first and second arms thereof are spaced apart to form a female connector or brought adjacent each other to form a male connector.

14. The shelter covering of claim 13, wherein the second arms of both the first and second Y-shaped connectors comprise respective first and second flaps that are affixed to the fabric material first end and the fabric material second end.

15. The shelter covering of claim 13, wherein the first and second ends of the fabric material comprise respective first and second doorways, and wherein the first and second Y-shaped connectors are respective located adjacent the first and second doorways.

16. The shelter covering of claim 13 wherein the first and second Y-shaped connectors each extend continuously along the respective first and second ends of the fabric material.

17. A method of interlocking adjacent members comprising:

providing a first Y-shaped connector affixed adjacent a first end of a first member and a second Y-shaped connector affixed adjacent a second end of a second member, wherein each of the first and second Y-shaped connectors includes a first arm with an outer face and an inner face, and a second arm with an outer face and an inner face, each of the outer faces including one of a loop-type engaging element and a hook-type engaging element, and each of the inner faces including the other of a loop-type engaging element and a hook-type engaging element;

forming a male configuration from the first and second arms of the first Y-shaped connector by locating the first and second arms of the first Y-shaped connector adjacent each other;

forming a female configuration from the first and second arms of the second Y-shaped connector by spacing the first and second arms of the second Y-shaped connector apart from each other;

placing the first end of the first member adjacent to the second end of the second member;

inserting the male configuration of the first Y-shaped connector between the spaced-apart first and second arms of the female configuration of the second Y-shaped connector such that the engaging elements located on the outer faces of the first and second arms of the first Y-shaped connector are located adjacent the engaging elements located on the inner faces of the first and second arms of the second Y-shaped connector; and lockably engaging the engaging elements located on the outer faces of the first and second arms of the first Y-shaped connector with the engaging elements located on the inner faces of the first and second arms of the second Y-shaped connector, thereby interlocking the first and second ends of the first and second members.

18. The method of claim 17, wherein:

both outer faces of both of the first and second Y-shaped connectors include said loop-type engaging element thereon; and both inner faces of both of the first and second Y-shaped connectors include said hook-type engaging element thereon.

19. The method of claim 17, wherein:

both inner faces of both of the first and second Y-shaped connectors include said loop-type engaging element thereon; and both outer faces of both of the first and second Y-shaped connectors include said hook-type engaging element thereon.

20. The method of claim 17 wherein the first and second members comprise structures and the first and second ends of the members comprise end walls of the structures.

* * * * *